US006516493B1

(12) United States Patent
Seliger et al.

(10) Patent No.: US 6,516,493 B1
(45) Date of Patent: Feb. 11, 2003

(54) GUIDE RAIL AND METHOD FOR PRODUCING A GUIDE RAIL FOR A CABLE OR BOWDEN TUBE WINDOW LIFT

(75) Inventors: Tillmann Seliger, Bamberg (DE); Craig Kinnell, Coburg (DE); Georg Kaemmler, Coburg (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 09/762,979

(22) PCT Filed: Aug. 12, 1999

(86) PCT No.: PCT/DE99/02514

§ 371 (c)(1),
(2), (4) Date: Feb. 14, 2001

(87) PCT Pub. No.: WO00/09846

PCT Pub. Date: Feb. 24, 2000

(30) Foreign Application Priority Data

Aug. 14, 1998 (DE) ..... 198 38 347

(51) Int. Cl.[7] ..... E05F 11/48

(52) U.S. Cl. ..... 16/96 R; 16/90; 49/349; 49/352

(58) Field of Search ..... 16/90, 94 R, 96 R; 49/349, 352

(56) References Cited

U.S. PATENT DOCUMENTS 3,844,064 A * 10/1974 Yamaha et al. ..... 49/348
4,494,336 A * 1/1985 Ishii et al. ..... 49/352
4,502,247 A * 3/1985 Kobayashi et al. ..... 49/352
4,663,886 A * 5/1987 Nakamura et al. ..... 49/360
4,835,907 A * 6/1989 Heuchert ..... 49/352
5,333,411 A 8/1994 Tschirschwitz et al. ..... 49/352
6,052,947 A * 4/2000 Smith ..... 49/352
6,425,204 B1 * 7/2002 Renner ..... 49/213

FOREIGN PATENT DOCUMENTS

| | | |
|---|---|---|
| DE | 41 31 098 | 3/1993 |
| EP | 0 385 167 | 9/1990 |
| EP | 0 561 440 | 9/1993 |

* cited by examiner

*Primary Examiner*—Anthony Knight
*Assistant Examiner*—E Peavey
(74) *Attorney, Agent, or Firm*—Christie, Parker & Hale, LLP

(57) ABSTRACT

A guide rail 10 for a cable or Bowden cable window lifter with a guide area 1 with slide faces 11, 12 for holding and the sliding guide of a follower mounted displaceable on the guide rail 10 and with at least one fastening area 31, 32 for connecting the guide rail 10 to a fixing base of a vehicle door is made at least in part of plastics and has a reinforcement area 2 connected to the guide area 1 and with reinforcement elements 20 of ribs and/or webs which are moulded on a surface of the reinforcement area 2 preferably integral and substantially perpendicular to the surface of the reinforcement area 2. The at least one fixing area 31, 32 is part of the reinforcement area 2 and the rear sides of the slide faces 11, 12 of the guide area 1 are not directly connected to the reinforcement elements (20). (FIG. 1).

31 Claims, 3 Drawing Sheets

GUIDE RAIL AND METHOD FOR PRODUCING A GUIDE RAIL FOR A CABLE OR BOWDEN TUBE WINDOW LIFT

DESCRIPTION

The invention relates to a guide rail for a cable or Bowden cable window lifter according to the preamble of claim 1 and to a method for manufacturing a guide rail for a cable or Bowden cable window lifter according to the preamble of claim 20.

Metal guide rails for cable window lifters are known where the surfaces are coated at least in part and which are a constituent part of a window lifter assembly structure which has to be assembled and fitted accordingly. Depending on the metal used and the number and type of joining and assembly processes the window lifter assembly structure manufactured in this way is relatively heavy. As a result of each of the manufacturing processes used for the individual parts and where necessary the surface coatings and as a result of each joining and assembly process used the risk of errors is considerably increased which can have a negative effect on the quality of the window lifter.

As a result of the relatively expensive manufacturing processes and thus the expense connected therewith for development and quality control the manufacturing costs are high. Furthermore as a result of the unfavourable friction pairing between the metal surfaces of the guide rails and the slide members for guiding the window pane it is also necessary in addition to lubricate the contact surfaces and where applicable to coat the guide rail.

From DE 41 31 098 C1 a guide rail is known for a cable window lifter where the guide areas are provided at the same time for fixing the guide rail on the door inside panel. For this purpose a fixing bolt is passed through the cable pulley, e.g. a cable roller, and is connected to the door inside panel. The force flow can thereby be introduced directly into the door bodywork without deflection through the guide rail so that the guide rail need mainly undertake the guide tasks and the transfer of transverse forces when closing the door. In this connection it is proposed to replace the guide rails of metal which have been used up until now by plastics guide rails. Further details on the structural design of plastics guide rails are not provided.

From EP 0 561 440 A1 an assembly support for assembling a window pane and a window lifter in a vehicle door is known which is made in one piece from plastics and which has a central fixing plate for holding the window lifter and several hollow spokes extending star-fashion from the central fixing plate and connected to this in one piece. The ends of the spokes are likewise provided with integral guide channels for holding the edges of the window pane. The hollow spokes have several fixing clips connected integral therewith and serving to fix the assembly support on the vehicle door.

The window guide channels for holding the window pane edges are defined by spaced side walls which consist of several brackets extending from a base and arranged off-set from each other on alternate sides. A slide strip of an elastomer is inserted in the window guide channels between the brackets in order to improve the sliding properties when guiding the edges of the window pane. As an alternative it is proposed to make the window guide channels from separate plastics material or from metal slide strips which are fixed in a suitable way at the ends of the hollow spokes of the assembly support. The required stiffness of the known assembly support is produced by the shape of the hollow spokes and by cross ribbing of the central fixing part.

The known plastics assembly support has a complex shape which can only be manufactured at considerable expense by observing close manufacturing tolerances. The known assembly support can only meet to a limited extent the requirements for the stability and guide properties which are required by a window lifter module, so that additional measures are necessary in order to increase the rigidity and to improve the sliding properties in the guide channels serving to hold the window pane.

From U.S. Pat. No. 4,835,907 a guide rail is known for a window lifter which has a longitudinally extended guide area for guiding a cable and which is provided at each end of this guide area with a deflection area for the cable guided in the guide area. These deflection areas serve to deflect the cable to a drive. In each of the deflection areas the cable is guided in a curved groove in which a plastics element is additionally inserted in order to improve the gliding properties. The deflection areas moreover serve as fixing areas for fixing the guide rails on a vehicle door and have reinforcement elements.

In EP 0 385 167 A1 a cable deflection member for a Bowden cable window lifter is described which is fixed at the ends of a profiled rail made from metal or plastics and which has an angled side wall for reinforcement.

The object of the present invention is to provide a guide rail and a method for manufacturing a guide rail for a cable or Bowden cable window lifter of the kind mentioned at the beginning which are adapted for using plastics as the material for at least a part of the guide rail.

This is achieved in respect of the guide rail by the features of claim 1 and in respect of the manufacturing process by the features of claim 19.

According to this at least the guide area of the guide rail consists of plastics and the guide rail has a separate reinforcement area with reinforcement elements connected to the guide area wherein the reinforcement area extends in the longitudinal direction of the rail at least over the middle section of the guide area and also encloses the fixing area of the guide rail.

Since the guide rail consists in part or completely of plastics and as a result of the structural division of the guide rail into a guide area which mainly undertakes the task of a slide guide, and a reinforcement area which ensures the required bending and torsion strength and mainly undertakes the mechanically supporting functions of the guide rail, the guide rail can be designed so that it has low weight and low manufacturing costs.

Through the now possible integration of several functions which hitherto were mostly produced from several individual parts which then had to be assembled, the risk of errors can be eliminated or reduced and the quality of the structural unit overall is improved.

The design of a guide rail according to the invention for a cable or Bowden cable window lifter is suitable both for the mechanical stresses of a guide rail in relation to the bending and torsion rigidity and also the tribological demands on a guide rail with regard to the abrasion strength, good sliding properties for guiding the pane and the lowest possible noise development.

Since the guide rail (more particularly its guide area) is made at least in part of plastics there is a greater freedom when designing the plastics parts. By matching tribologically particularly suited friction pairings of plastics between the guide area of the rail and the slide member for guiding the window pane there is the possibility of using this friction pairing without additional lubrication and of improving the product economically and technologically.

The reverse sides of the slide faces of the guide area are preferably not directly connected to the reinforcement elements so that the necessary but also adequate separation between the guide area and the reinforcement area is ensured. Reinforcement elements can thus be arranged in all areas of the guide rail, only not in the area of the slide faces, i.e. in the area of the path of the window pane follower. The front side of the guide faces or areas thereby forms the contact with the window pane followers or sliders.

The reinforcement elements preferably consist of ribs and/or webs which are formed on a surface of the reinforcement area preferably integral and substantially perpendicular to the surface of the reinforcement area. The ribs and/or webs can be formed in particular as waffle pattern or as cross ribbing. Alternatively the reinforcement elements can consist of hollow profiled sections.

A favourable stiffness/mass ratio is reached through the arrangement of reinforcement elements, such as ribs, webs or hollow profiles, in the reinforcement area.

Preferably ribs and/or webs extending like rays from the force introduction points are arranged around the force introduction points, for example in the area of the fixing points for connecting the guide rail to an internal panel, a door module or the like and/or about fixing points for additional component parts such as window lifter motors, cable pulleys or the like.

The forces emanating from the fixing points are thereby introduced directly into the cross rib structure of the reinforcement area so that the stability of the guide rail is also guaranteed at these necessary weak spots.

By dividing the guide rail into a reinforcement area and a guide area the prerequirement is provided so that the reinforcement area can be made from a plastics with high mechanical strength and the guide area can be made from a plastics with good tribological properties, whereby both areas can be connected integral together and thus produce one structural unit. By manufacturing the guide rail in the twin- or multi-component injection casting process it is possible to divide the guide rail into a reinforcement area with a material of high strength and high E-modulus and a guide area with webs, ribs or guide elements of a tribologically favourable material which has optimum low friction values, low wear and low noise level.

The guide and reinforcement functions are thus structurally separated whereby the guide area (which can be pressed, cast or drawn from plastics with particular advantage) can be made without reinforcement elements and can be spatially separated from the areas subjected to higher mechanical stresses (reinforcement area), with only the reinforcement area being provided with reinforcement elements.

It has thereby proved advantageous to connect the guide area with the reinforcement area through a short lever arm and to select a greater material thickness at least for some parts.

The reinforcement area is preferably designed on the principle of a bending support structure and has additional plastics-reinforcing fibres, more particularly glass or carbon fibres. By way of example the middle part of the reinforcement area has a larger cross-section than the ends.

In the case of a combination of a plastics guide rail with a metal profile the reinforcement area of the rail is made from metal whilst the guide area is made from plastics owing to the better tribological properties. The reinforcement area thereby consists of a metal profile with favourable mechanical properties and is characterised by a high resistance moment with a relatively light weight. The guide area which is made of plastics is connected with keyed and/or force locking engagement to the metal profile, for example by completely or partially overmoulding the metal profile which forms the support structure, through co-extrusion of the plastics on the metal profile or through subsequent joining of the plastics and metal through adhesive, welding, clips or push-fit connection.

When injecting plastics round the metal profile the plastics can in addition to the guide function also contribute to a deliberate additional strengthening of the metal profile whereby ribs and reinforcements produce a hybrid structure which is resistant to both bending and torsion. In this way a simple bending-resistant metal profile can be made with plastics ribs or plastics structure into a torsion and bending resistant function element.

Furthermore the metal profile can be fitted into a channel of the plastics body of the guide rail. Alternatively a plastics structure can be injected onto the bending-resistant metal profile in order to improve the torsion resistance. Since for example a U-profile is not very resistant to distortion, by injecting a plastics structure onto same the profile becomes resistant to distortion although the plastics itself is being used in particular on account of its good tribological properties.

The guide areas in the form of guide webs, ribs or guide elements can be coated with an anti-friction paint or can be vacuum- or plasma-coated with a suitable substrate, for example by means of plasma—CVD coating in order to improve the tribological properties. The anti-friction paint can thereby also be used on the plastics when the plastics has a particularly good bearing capacity with good mechanical strength properties but does not have particularly good tribological properties.

An improvement to the tribological properties as well as also to the mechanical properties can be achieved by cross-linking the molecular structure of at least the surface of the material used, for example through the action of suitable chemical means or through ionising radiation, more particularly gamma radiation. A thermoplastics material is thereby changed at least in part into the duroplastics state.

The strength and stiffness of the plastics rail can be further improved by using special tool and method techniques, for example by using a cascade casting system, which avoids undesired binding seams, or through counter-beat injection casting with fibre-reinforced or LCP materials, whereby a strengthened orientation of the molecular structure and thus a higher E-modulus is obtained.

As opposed to the continuous metal profile, the reinforcement area can be shaped so that the cross-section is suitably configured over the length according to the bending moment which occurs.

In order to manufacture the plastics rail it is possible, particularly when using thermoplastics reinforced with oblong glass fibres, to use an injection stamping or gas internal pressure process so that the material properties can be utilised in the best possible way and manufacture is achieved with little distortion.

In order both to make the plastics rail mechanically rigid and nevertheless to produce on the surface the most favourable surface condition for friction pairing all without any expensive tool technology, it is advantageous to use the 2-plastics injection in the overmoulding process. The surface, more particularly the guide area exposed to the tribological strain, can thereby be formed by unstrengthened material whilst the core is formed by a fibre-reinforced material.

Flexible areas can be arranged at the transitions between the reinforcement area and the fixing points of the guide rail in order to provide compensation for the length and/or angular tolerances and where necessary any existing thermal expansion differences between the guide rail and the door structure.

The guide rail can integrate as a plastics component part further adjoining component parts or their functions. These can be for example a base plate, a bearing cover, bearing spots and fixing spots. The guide rail can be a constituent part of a larger door module, which integrates further functions, such as for example a door lock, door electronics and sealing functions.

Further integration possibilities are injection moulding the guide pulleys with subsequent rotatable bearing in the 2-plastics process. A pre-requisite for this is the fixing, for example riveting or screwing of the rail on the door structure at the bearing points of the guide pulleys.

The idea on which the invention is based will now be explained with reference to the embodiments illustrated in the drawings in which.

Figure 1:
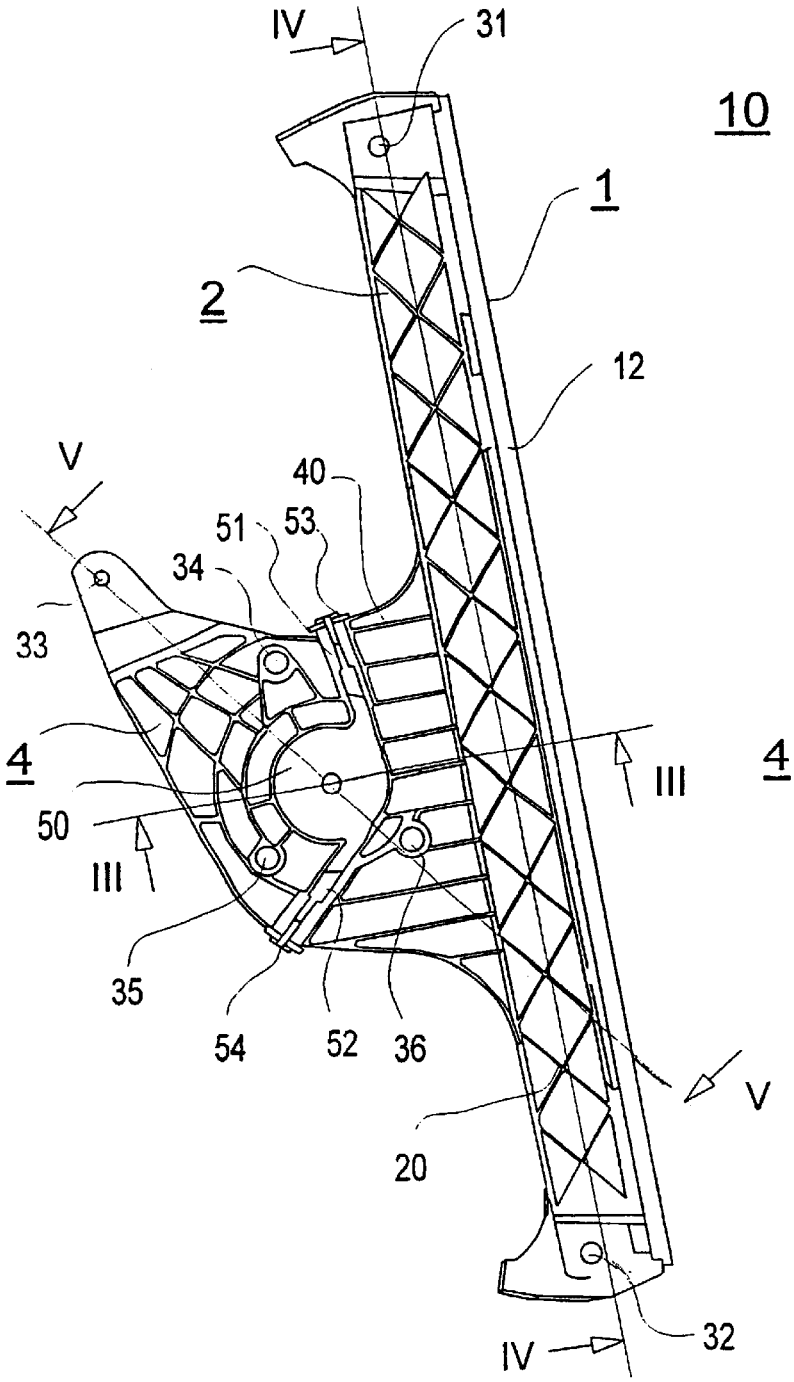
FIG. 1 shows a plan view of a guide rail with a guide area, a reinforcement area as well as fixing and connecting spots.
Figure 2:
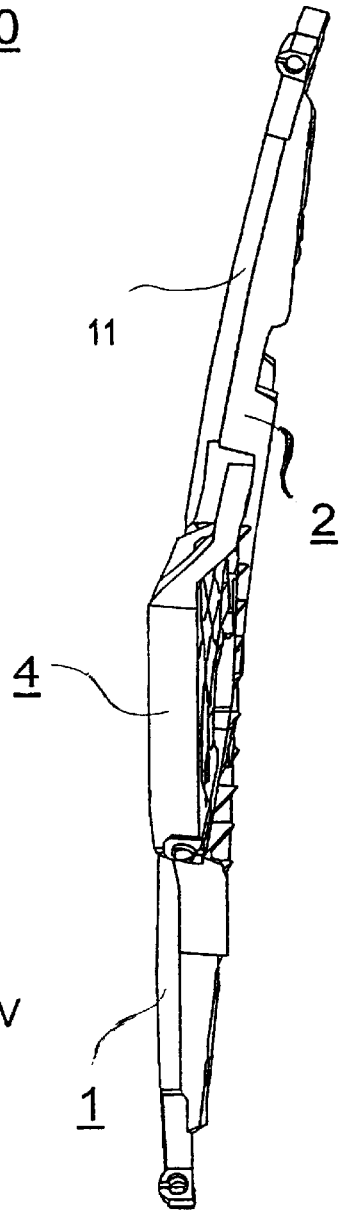
FIG. 2 shows a perspective side view of the guide rail according to FIG. 1.
Figure 3:
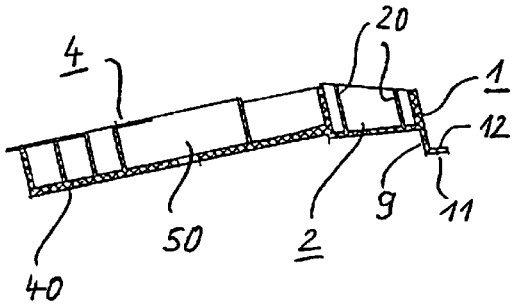
FIG. 3 shows a section through the guide rail along the line III—III of FIG. 1.
Figure 4:
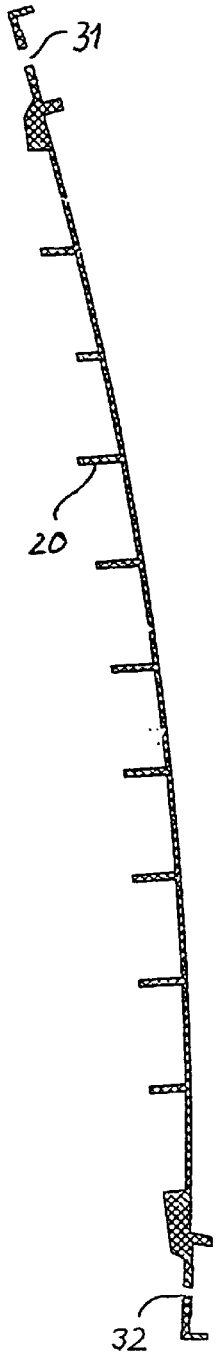
FIG. 4 shows a section through the guide rail along the line IV—V of FIG. 1.
Figure 5:
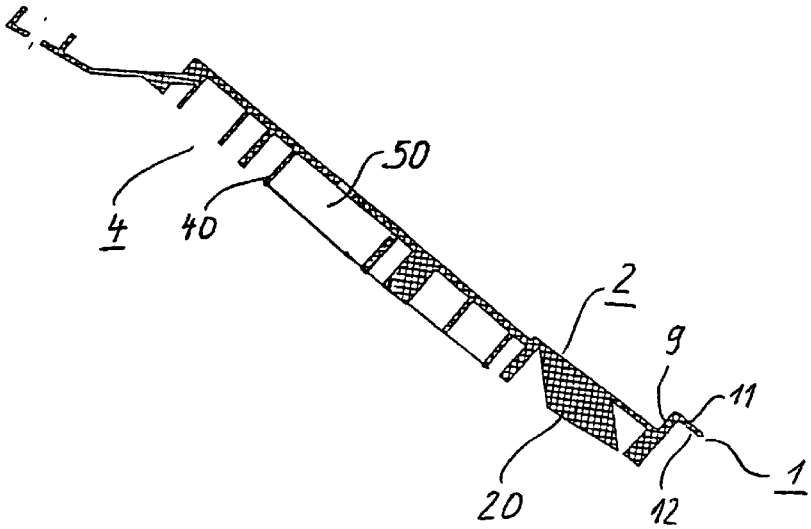
FIG. 5 shows a section through the guide rail along the line V—V of FIG. 1.

The guide rail 10 which is shown in plan view in FIG. 1, in a perspective side view in FIG. 2 and in several sectional views in FIGS. 3 to 5 has an integral moulded base plate or bearing point 4 for a cable pulley and connecting points 34 to 36 for a bearing cover or a window lifter drive and consists entirely of plastics or of a metal profile partially covered with plastics in the design, material selection and material composition as described above. The guide rail 10 is divided into a guide area 1 and a reinforcement area 2 and has two fixing points 31, 32 at which it is connected to a fixing base of a vehicle door, for example a support plate or a door inside panel.

The guide area 1 has a front slide face 11 and a rear slide face 12 for holding a window pane follower or slider which slides along the longitudinal direction of the guide rail 10 on the slide faces 11, 12 whilst engaging with keyed engagement round same.

The reinforcement area 2 has reinforcement elements 20 which protrude perpendicularly from the surface of the reinforcement area 2 and which form a waffle pattern or a cross ribbing. As can be seen in particular from the sectional view in FIG. 3 along the line III—III and FIG. 5 along the line V—V according to FIG. 1, the guide area 1 is connected to the reinforcement area 2 through a short lever arm 9 so that a high resistance torque is guaranteed against bending of the guide area 1 as a result of the follower with the window pane fixed thereon sliding along the slide faces 11, 12. Furthermore FIGS. 1, 3 and 5 show that the slide face 12 which forms the rear side of the guide faces of the guide area 1 is not connected to the reinforcement elements 20 of the reinforcement area 2 which are formed as ribs or webs, since an additional web 9 is mounted between the guide area 1 and the reinforcement area 2 and connects both areas together in one piece.

The bearing spot 4 adjoining the reinforcement area 2 has a number of ribs or webs 40 protruding perpendicular from the base face of the bearing spot 4 and arranged partially like rays around connecting points 34 to 36 for a bearing cover, window lifter drive or the like, thereby ensuring the optimum force transfer to the reinforcement area 2. In the same way parallel running ribs or webs serve to increase the strengthening structure of the guide rail 10.

The bearing spot 4 has a hollow cylindrical interior 50 as part of a drive housing from which two insert channels 51, 52 extend for a drive cable whose Bowden sleeve is connected to the drive housing at Bowden supports 53, 54. The drive cable is connected each time through an upper and lower pulley in the region of the fixing points 31, 32 to the follower which is guided adjustable on the guide area 1. A cable drum is inserted in the hollow cylindrical interior 50 of the drive housing, with the cylindrical outer face of the drum being provided with cable guides for holding the drive cable.

A further fixing spot 33 serves for attaching the bearing spot 4 or for additionally supporting the guide rail 10 on the fastening base of the vehicle door, i.e. on a support plate, a door inside panel or a door module in which the guide rail 10 can also be integrated when necessary.

The guide rail shown in FIGS. 1 to 5 can be made selectively either completely or partially of plastics with the aforementioned structural features and compositions of the plastics. By dividing the guide rail into a guide area and a reinforcement area it is possible to choose a twin or multi component injection moulding process wherein the reinforcement area consists of a material with high strength and high E-modulus, and for the guide area a tribologically favourable material is chosen which is best with regard to low friction values, low wear and low noise level.

In an alternative embodiment the reinforcement area of the guide rail can also be made from a metal profile having favourable mechanical properties which ensures a high resistance with relatively low weight, whilst the guide area is made from plastics owing to the better tribological properties. Both areas can be connected together with positive and/or force locking engagement, for example through injecting plastics round the metal profile which apart from the guide function also contributes to the deliberate additional reinforcement of the metal profile in that a hybrid structure is produced through ribs and reinforcements which is resistant to both bending and torsion.

Figure 6:
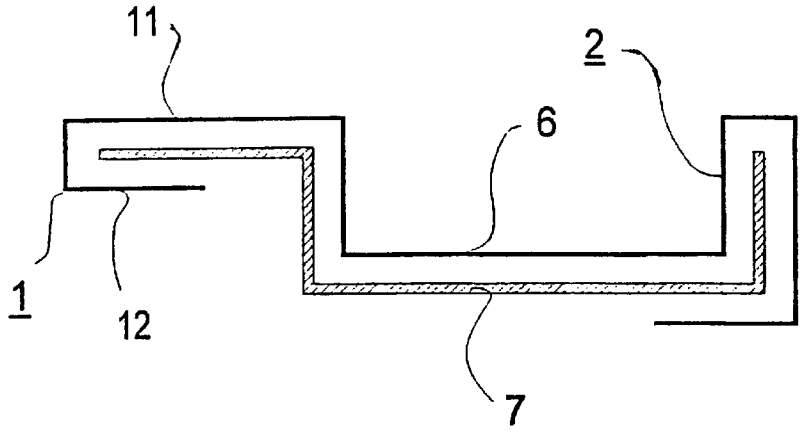
FIG. 6 shows a diagrammatic sectional view through a metal profile partially injection-moulded in plastics.

A structure of this kind is illustrated in FIG. 6 which shows a metal profile 7 which is encased in part in plastics 6, namely there where the guide area 1 or the slide faces 11, 12 requires this and in addition in the areas of the reinforcement area 2 for further reinforcement of the metal profile as well as for injection moulding reasons for the positive locking connection of the plastics 6 with the metal profile 7.

As an alternative to this the connection between the metal profile and the plastics can be produced by co-extrusion or through subsequent joining processes in the form of adhesive, welding, clips or push-fit connection.

Both in the arrangement according to FIG. 6 and in the arrangement described above according to FIGS. 1 to 5 the guide area 1 can additionally be vacuum- or plasma-coated with an anti-friction paint or with a suitable substrate in order to improve further the tribological properties of the guide area 1 in this way.

Figure 7:
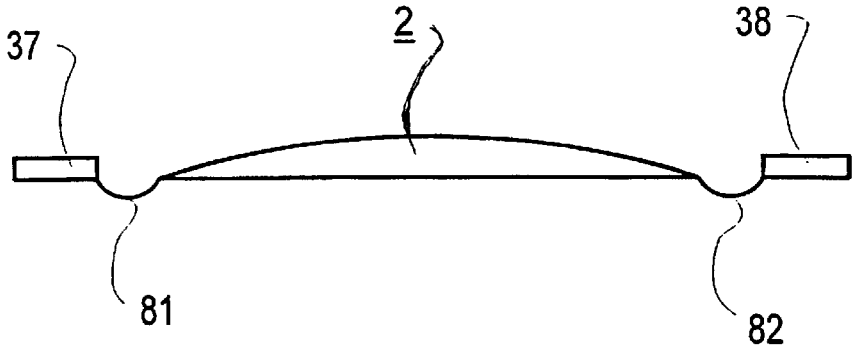
FIG. 7 shows a diagrammatic side view.
Figure 8:
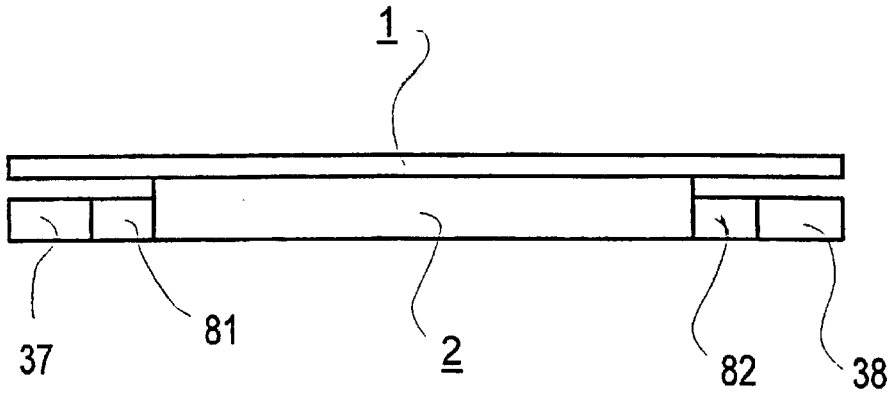
FIG. 8 shows a diagrammatic plan view of guide rail with longitudinal extension areas between the reinforcement and fastening area.

In FIGS. 7 and 8 a further possibility is shown of adapting the features of a guide rail according to the invention.

This embodiment shows a reinforcement area 2 which is designed on the principle of the bending support structure and has in the middle a larger cross-section than at the ends. These are adjoined by flexible areas 81, 82 which connect the reinforcement area 2 to the fixing spots 37, 38 and provide compensation for the length and/or angular tolerances as well as thermal expansion differences between the guide rail and the fixing base of the vehicle door. The reinforcement area 2 is connected in the manner described above to the guide area 1 so that the reverse sides of the slide faces of the guide area are not directly connected to the reinforcement elements of the reinforcement area 2.

In this configuration as well as in the embodiment according to FIGS. 1 to 5 further adjoining component parts or their functions can be integrated in the guide rail, such as for example a base plate, bearing cover, bearing spots or fastening spots. A further integration possibility exists in overmoulding the guide pulleys with subsequent rotatable bearings in the twin or multi component injection moulding process whereby the guide rail in a first injection moulding process is injected with cavities in the area of the guide pulleys and axles and in a second injecting process the guide pulley is injected out. The fixing, i.e. riveting or screwing of the guide rail on the fixing base of the vehicle door can take place according to the features of DE 41 31 098 by connecting the axle of the guide pulley directly to the fixing base.

What is claimed is:

1. A guide rail for a cable window lifter of a vehicle door comprising:

a guide area having glide faces for holding and guiding a window follower, which can be displaceably mounted on the guide area;

a separate reinforcement area, having reinforcement elements connected to the guide area, extending in a longitudinal direction at least over a middle section of the guide area, and having at least one attachment spot for connecting the guide rail to a fixing base of a vehicle door; and wherein at least the guide area includes a plastic material.

2. The guide rail of claim 1 wherein the guide area includes a front and a rear slide face, such that the rear slide face is not connected directly to the reinforcement elements.

3. The guide rail of claim 1 wherein the reinforcement elements include at least one of ribs and webs.

4. The guide rail of claim 1 wherein the reirforcement elements are oriented in one of a waffle pattern and a cross-ribbed pattern.

5. The guide rail of claim 1 wherein the reinforcement area has a plurality of attachment spots which are arranged in one of parallel rows around the attachment spots and a radial pattern extending from the attachment spots.

6. The guide rail of claim 1 wherein the reinforcement elements contain hollow profiles.

7. The guide rail of claim 1 wherein the reinforcement area includes a bending support structure and the plastic material includes one of glass and carbon reinforcing fibers.

8. The guide rail of claim 1 wherein the reinforcement area includes one of a metal profile and a plastic profile having a reinforcing metal profile.

9. The guide rail of claim 8 wherein the metal profile is over-molded by one or completely and partially with a plastic covering.

10. The guide rail of claim 8 wherein the metal profile is connected to the plastic material by one of adhesives, welds and clips.

11. The guide rail of claim 8 wherein the plastic material of the guide area includes a channel into which the metal profile is inserted.

12. The guide rail of claim 8 wherein a plastic structure is injected into the metal profile to improve the torsion resistance and tribological properties of the metal profile.

13. The guide rail of claim 8 wherein the metal profile is formed by co-extrusion with the plastic material.

14. The guide rail of claim 8 wherein the guide area comprises a part of the metal profile and is coated with an anti-friction paint.

15. The guide rail of claim 1 wherein the plastic material is molded by a twin or multi-component plastic technique.

16. The guide rail of claim 1 wherein the reinforcement area includes a flexible material disposed adjacent to the at least one attachment spot, which provides compensation for length and/or angular tolerances as well as thermal expansion differences between the reinforcement area and the fixing base of the vehicle door.

17. The guide rail of claim 1 further comprising an integrally molded base plate for one of a gearing element and several gearing elements.

18. The guide rail of claim 1 wherein the guide rail is a constituent part of a plastic door module.

19. The guide rail of claim 1 wherein the reinforcement elements are formed integral to and extend substantially perpendicularly from a surface of the reinforcement area.

20. A method for manufacturing a guide rail for a cable window lifter comprising:

producing a guide area having slide faces for holding and guiding a window follower which is displaceably mounted on the guide area;

producing a separate reinforcement area, having reinforcement elements connected to the guide area, extending in a longitudinal direction at least over the middle section of the guide area and having at least one attachment spot for connecting the guide rail to a fixing base of a vehicle door; and wherein at least the guide area of the guide rail is constructed from the one of drawing, pressing and casting a plastic material.

21. The method of claim 20 wherein the plastic material is a homogeneous plastic material.

22. The method of claim 20 wherein the plastic material is at least one of a mixture and a connection of plastic materials having different properties.

23. The method of claim 20 wherein the guide rail includes a combination of plastic portions and metal portions.

24. The method of claim 23 further comprising:

over-molding a metal support structure, which is coupled to the reinforcement area, completely or in part with a plastic covering.

25. The method of claim 23 further comprising:

co-extruding a plastic covering onto a metal profile which is coupled to the reinforcement area.

26. The method of claim 23 further comprising:

connecting the plastic portions and the metal portions of the guide rail together utilizing a connector chosen from the group consisting of bonding, welding, clipping and push fitting.

27. The method of claim 23 further comprising:

forming a bending-resistant metal profile, in hybrid technology with plastic ribs and/or a plastic structure, into a torsion and bending resistant function element.

28. The method of claim 23 further comprising:

treating the plastic material by a means which leads to an improvement in the tribological properties of the plastic material.

29. The method of claim 23 further comprising:

cross-linking of the molecular structure of the plastic portions and the metal portions by an action of suitable chemical means or by ionizing radiation.

30. The method of claim 23 further comprising:

transforming the plastic material from a thermoplastic into a duroplastic state.

31. The method of claim 23 further comprising:

uniformly aligning a molecular structure of the plastic portion through a group consisting of counter-beat injection casting, injection-stamping with glass fibers and over-molding.

* * * * *

UNITED STATES PATENT AND TRADEMARK OFFICE

CERTIFICATE OF CORRECTION

PATENT NO. : 6,516,493 B1
DATED : February 11, 2003
INVENTOR(S) : Tillmann Seliger et al.

It is certified that error appears in the above-identified patent and that said Letters Patent is hereby corrected as shown below:

Title page,
Item [57], ABSTRACT, delete the abstract and substitute therefor -- A guide rail for a cable or Bowden cable window lifter with a guide area with slide faces for holding the sliding guide of a follower mounted displaceably on the guide rail and with at least one fastening area for connecting the guide rail to a fixing base of a vehicle door. The guide rail is made at least in part of plastic and has a reinforcement area connected to the guide area. Reinforcement elements of ribs and/or webs are molded on a surface of the reinforcement area preferably integral and substantially perpendicular to the surface of the reinforcement area. The fastening area is part of the reinforcement area and the rear sides of the slide faces of the guide area are not directly connected to the reinforcement elements. --

Signed and Sealed this

Fourth Day of January, 2005

JON W. DUDAS
*Director of the United States Patent and Trademark Office*